US008673836B2

(12) United States Patent
Hamelin et al.

(10) Patent No.: US 8,673,836 B2
(45) Date of Patent: Mar. 18, 2014

(54) LAUNDRY DETERGENT COMPOSITION WITH A REACTIVE DYE

(75) Inventors: Bertrand Noel Hamelin, Brussels (BE); Tina Vanden Bempt, Bierbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/075,565

(22) Filed: Mar. 12, 2008

(65) Prior Publication Data

US 2008/0234168 A1 Sep. 25, 2008

Related U.S. Application Data

(60) Provisional application No. 60/919,089, filed on Mar. 20, 2007.

(51) Int. Cl.
*C11D 3/37* (2006.01)

(52) U.S. Cl.
USPC ..... 510/276

(58) Field of Classification Search
USPC ..... 510/276
See application file for complete search history.

(56) References Cited

U.S. PATENT DOCUMENTS

| | | | | |
|---|---|---|---|---|
| 5,356,441 | A * | 10/1994 | Tokieda et al. | 8/543 |
| 5,536,277 | A * | 7/1996 | Shimode et al. | 8/549 |
| 5,570,557 | A | 11/1996 | Kwiatkowski et al. | |
| 5,770,552 | A * | 6/1998 | Bruhnke | 510/343 |
| 6,245,117 | B1 * | 6/2001 | Nishikawa et al. | 8/116.1 |
| 6,530,961 | B1 * | 3/2003 | Schrell et al. | 8/549 |
| 6,712,862 | B1 * | 3/2004 | Grimm et al. | 8/524 |
| 7,846,268 | B2 | 12/2010 | Smets et al. | |
| 2006/0019860 | A1 * | 1/2006 | Cardozo et al. | 510/445 |

FOREIGN PATENT DOCUMENTS

| | | |
|---|---|---|
| WO | WO 2005/003277 A1 | 1/2005 |
| WO | WO 2006/027086 | 3/2006 |

OTHER PUBLICATIONS

PCT Search Report, Application No. PCT/IB2008/050998, dated Jul. 21, 2008, containing 12 pages.

* cited by examiner

*Primary Examiner* — Ling Choi
*Assistant Examiner* — Thuy-Ai Nguyen
(74) *Attorney, Agent, or Firm* — Melissa G Krasovec

(57) ABSTRACT

Laundry detergent compositions comprising 0.00001% to 0.01% by weight of reactive dyes are disclosed. The laundry detergent compositions provide the benefit of imparting a favorable shade to fabrics without undesirable buildup of dyes on the fabrics.

1 Claim, No Drawings

LAUNDRY DETERGENT COMPOSITION WITH A REACTIVE DYE

CROSS REFERENCE TO RELATED APPLICATION

This application claims the benefit of U.S. Provisional Application No. 60/919,089, filed Mar. 20, 2007.

FIELD OF THE INVENTION

The present invention relates to a laundry detergent composition comprising a dye. Specifically, the present invention relates to a laundry detergent composition comprising a dye which imparts a favorable shade to fabrics without accumulating on the fabrics.

BACKGROUND OF THE INVENTION

Wearing and laundering of fabric articles can result in a discoloration of the fabric articles from the original fabric color. For example, white fabrics which are repeatedly laundered can exhibit a yellowish appearance which makes the fabric look older, stained and/or worn. To overcome the undesirable yellowing of white fabrics, and similar discoloration of other light colored fabrics, it is desirable to formulate a hueing dye in a laundry detergent composition so as to impart a favorable hue to the fabrics by laundering such fabrics in an aqueous solution of the laundry detergent composition.

Hueing dyes used in laundry detergent composition are typically an acid dye, a basic dye or in some cases, a direct dye. However, after repeated laundering of textile with detergent containing such hueing dyes, the hueing dye tends to accumulate on the textile, giving the textile a tint of the dye. For example, repeated laundering of white fabric articles with a laundry detergent composition comprising a blue dye tends to give the articles a bluish, rather than white, appearance. The shades of pastel colored fabrics tend to change as well upon repeated laundering with detergents containing hueing dyes. Hence the use of such dyes tends to present a trade-off between hue benefit and tint accumulation.

Another group of dyes, reactive dyes have been used in the textile manufacturing industry for coloring textiles by covalent bonding to the fabric under conditions like high pH, high temperature and/or high dye concentration, and for ink-jet printing of textiles, but not in the laundry detergent field. Indeed, some prior art, such as WO 2006/027086 teaches that reactive dyes can not be used in a laundry treatment composition, since the functional groups in a reactive dye can allegedly cause irritation/sensitization of respiratory tract and skin. Such prior art, thus teaches to use hydrolysed reactive dyes to impart desired shading to textiles. However, hydrolysed reactive dyes are not as commercially available as the reactive dyes are. Since additional hydrolysation process is needed for preparing the hydrolysed reactive dyes, the cost of hydrolysed reactive dye becomes higher than reactive dye and the quality control of hydrolysed reactive dye is much more complex than that of a reactive dye. In short, application of hydrolysed reactive dyes in laundry detergent compositions is less practical than that of reactive dyes.

Accordingly, a need exists for improved laundry detergent compositions which can impart a favorable hue to fabrics without undesirable accumulation on the fabrics by laundering the fabrics.

SUMMARY OF THE INVENTION

The present invention provides a laundry detergent composition containing from about 3% to about 50% by weight of a surfactant and from about 0.00001% to about 0.01% by weight of a reactive dye. It has been found that some reactive dyes can be used in a laundry detergent composition at the specified level without any concern of causing irritation and/or sensitization issues. It has also been found that compared to the known laundry detergent compositions comprising hueing dyes, the laundry detergent composition comprising a reactive dye at the specified level gives a brighter hue to fabrics without undesirable buildup of the dye on the fabrics. In addition, the laundry detergent composition herein imparts a desirable shade to fabrics in fewer wash cycles of said fabrics in an aqueous solution of the laundry detergent composition, i.e. the dyeing equilibrium of the laundered fabrics is reached more quickly by laundering the fabrics with the laundry detergent compositions herein. Without intending to be bound by theory, it is believed that the reactive group on the reactive dye provides an increased solubility to the dye, helping balancing hue benefit and dye accumulation while the hydrolyzation of the reactive group gives a different behavior to the dye not described here, that would result in a decreased performance.

In another aspect of the present invention, a method for treating fabrics is provided. Said method includes the steps of contacting the fabrics with an aqueous solution of the laundry detergent composition herein at a temperature of less than 40° C. and a pH of about 9-10 and rinsing and drying the fabrics, wherein said aqueous solution of the laundry detergent composition herein comprises from about 0.0005 ppm to about 0.5 ppm by weight of a reactive dye.

DETAILED DESCRIPTION OF THE INVENTION

Unless otherwise specified, all percentages, ratios or parts herein are on a weight basis.

Reactive Dye

The laundry detergent composition herein comprises from about 0.00001% to about 0.01%, or from about 0.0001% to about 0.005% by weight of a reactive dye.

Reactive dyes are a group of dyes capable of forming covalent bonds with substrate under suitable dyeing conditions. From the chemical structure point of view, a typical reactive dye comprises a chromophore group and one or more functional groups, the so-called anchor groups which may react with a substrate, such a cellulose, wool, silk and polyamide fibers under dyeing conditions. Typical chromophore groups of reactive dyes are azo, anthraquinone, phthalocyanine, formazan and triphendioaxazine. Typical anchor groups of reactive dyes are trichloropyrimidinyl, monochlorotriazinyl, vinylsulfonyl, dichloroquinoxalinyl, monofluorotrazinyl, difluorochloropyrimidinyl and dichlorotriazinyl. Addition and substitution reaction are two possible reaction mechanisms between reactive dyes and fabric fibers. However, in the textile industry, such reactions typically occur under a suitable dyeing condition, such as a high level of reactive dyes in a dyeing bath, a temperature of higher than 40° C., a dyeing bath pH of 10-12 as well as co-existence of other components in the dyeing bath. Since the washing condition is much milder than the dyeing condition, it is believed that the reactive dye does not react covalently with fabrics laundered in an aqueous solution of the laundry detergent compositions herein. Without intending to be bound by theory, it is believed that the reactive dye may also deposit on a fabric surface by hydrophobic or electrostatic interactions to impart a desirable shade to the fabrics.

According to one embodiment herein, the laundry detergent compositions herein contain a combination of reactive dyes of different shades selected from the group consisting of a reactive blue dye, a reactive violet dye, a reactive red dye and a reactive green dye. Such a combination of reactive dyes of different shade will provide a formulator the capability of selecting a shade and brightness more precisely.

Non-limiting reactive dyes suitable for use herein include those having Color Index (C. I.) name of: C. I. Reactive Blue 268, C. I. Reactive Red 238, C. I. Reactive Blue 224, C. I. Reactive Violet 33, C. I. Reactive Blue 209, C. I. Reactive Blue 19 and C. I. Reactive Red 239. All of these reactive dyes are commercially available from various sources.

In a non-limiting preferred embodiment, the reactive dye is a combination of a reactive blue dye and a reactive red dye in a weight ratio of from about 1:9 to about 9:1, or from about 1:5 to about 5:1. This combination of reactive blue dye and reactive red dye is specifically preferred as such a combination gives a violet hue to fabrics which is specifically preferred by some consumers. Preferably, the reactive blue dye is selected from a group consisting of C. I. Reactive Blue 268, C. I. Reactive Blue 224, C. I. Reactive Blue 209, C. I. Reactive Blue 19 and a mixture thereof, the reactive red dye is selected from the group consisting of C. I. Reactive Red 238, C. I. Reactive Red 239 and a mixture thereof.

Surfactant

The laundry detergent composition herein comprises from about 3% to about 50%, or from about 8% to about 30%, or from about 10% to about 20% of a surfactant selected from the group consisting of an anionic, a nonionic, a cationic, a zwitterionic, an amphoteric surfactant and a mixture thereof. In a more specific embodiment, the detergent composition comprises anionic surfactant, nonionic surfactant, or mixtures thereof.

Suitable anionic surfactants useful herein can comprise any of the conventional anionic surfactant types typically used in liquid and/or solid detergent products. These include the alkyl benzene sulfonic acids and their salts as well as alkoxylated or non-alkoxylated alkyl sulfate materials. Exemplary anionic surfactants are the alkali metal salts of C10-16 alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium C11-C14, e.g., C12, LAS is a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: R'—O—$(C_2H_4O)$n-$SO_3M$ wherein R' is a C8-C20 alkyl group, n is from about 1 to 20, and M is a salt-forming cation.

Suitable nonionic surfactants useful herein can comprise any of the conventional nonionic surfactant types typically used in liquid and/or solid detergent products. These include alkoxylated fatty alcohols and amine oxide surfactants. Suitable alcohol alkoxylate nonionic surfactants useful herein may correspond to the general formula: $R(C_mH_{2m}O)_nOH$, wherein R is a C8-C16 alkyl group, m is from 2 to 4, and n ranges from about 2 to 12. Another suitable type of nonionic surfactant useful herein comprises the amine oxide surfactants. Amine oxides are mateials which are often referred to in the art as "semi-polar" nonionics. Amine oxides have the formula: $R(EO)_x(PO)_y(BO)_zN(O)(CH_2R')_2$. In this formula, R is a relatively long-chain hydrocarbyl moiety which can be saturated or unsaturated, linear or branched, and can contain from 8 to 20, or from 10 to 16 carbon atoms. R' is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by C12-14 alkyldimethyl amine oxide.

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine (APA).

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, C8 to C18 (preferably C12 to C18) amine oxides and sulfo and hydroxy betaines, such as N-alkyl-N,N-dimethylammino-1-propane sulfonate where the alkyl group can be C8 to C18, preferably C10 to C14.

Bleaching Agent

In a non-limiting preferred embodiment, the laundry detergent compositions herein contain a bleaching agent. A bleaching agent is preferred herein in the sense of controlling buildup of hueing dyes on fabrics, which may become a concern after the fabrics being laundered for multiple times with the laundry detergent compositions containing such hueing dyes. When present, bleaching agents will typically be at levels of from about 1% to about 30%, or from about 5% to about 20% by weight of the laundry detergent compositions.

The bleaching agents used herein can be any of the bleaching agents useful for detergent compositions in textile cleaning that are now known or become known. These include oxygen bleaches as well as other bleaching agents. Perborate bleaches, e.g., sodium perborate (e.g., mono- or tetra-hydrate) can be used herein. Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al. Peroxygen bleaching agents can also be used. Suitable peroxygen bleaching agents include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. A preferred percarbonate bleaching agent comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka. Mixtures of bleaching agents can also be used.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

Adjunct Ingredients

The laundry detergent compositions herein can also include any number of additional adjunct ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 0.01% to about 90%, or from about 1% to about 70%, or from about 10% to about 30% by weight of the composition.

In a non-limiting preferred embodiment, the laundry detergent compositions herein are provided in a tablet form and contain one or more ingredients, such as an effervescent a non-gelling binder.

An effervescent typically presents in a laundry detergent tablet at a level of from 5% to 20%, or from 10% to 15% by weight of the detergent tablet. Effervescency as defined herein means the evolution of bubbles of gas from a liquid, as the result of a chemical reaction between a soluble acid source and an alkali metal carbonate, to produce carbon dioxide gas. Examples of acid and carbonate sources and other effervescent systems may be found in: Pharmaceutical Dosage Forms: Tablets, Volume 1, Pages 287 to 291. An effervescent may be added to the tablet mixture in addition to the detergent ingredients. The addition of this effervescent to the detergent tablet improves the disintegration time of the tablet. Preferably the effervescent should be added as agglomerate of the different particles or as a compact, and not as separated particles.

A non-gelling binder typically presents in a laundry detergent tablet at a level of from 0.1% to 15%, or from 0.5% to 5% by weight of the detergent tablet. Non-gelling binders can be integrated in detergent compositions to further facilitate dissolution. Suitable non-gelling binders include synthetic organic polymers such as polyethylene glycols, polyvinylpyrrolidones, polyacrylates and water-soluble acrylate copolymers. The handbook of Pharmaceutical Excipients, second edition, has the following binder classifications: Acacia, Alginic Acid, Carbomer, Carboxymethylcellulose sodium, Dextrin, Ethylcellulose, Gelatin, Guar gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Preferred non-gelling binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers. Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

Product Form

The laundry detergent compositions herein may be in the form of a solid, either in tablet or particulate form, including, but not limited to particles, flakes, or the like, or the compositions may be in the form of a liquid. Depending on the form of the laundry detergent compositions, the reactive dyes can be added as a powder, as a granule, as a liquid solution by dusting one part or the total of the detergent product, by spraying onto the detergent product or by simply adding as a solution into a liquid detergent.

In one embodiment, the laundry detergent composition herein is provided in a tablet form. A laundry detergent tablet typically has a diameter of between 20 mm and 60 mm, and typically having a weight of from 10 g to 100 g. However, in one embodiment herein, the combined weight of the tablets making up one dose should be less than 75 g, preferably less that 70 g, and more preferably less than 65 g, but more than 10 g, preferably more than 15 g, and more preferably more than 20 g. The ratio of tablet height to tablet width is typically greater than 1:3 and less than 1:1. The tablet typically has a density of at least 900 g/l, preferably at least 950 g/l, and preferably less than 2,000 g/l, more preferably less than 1,500 g/l, and even more preferably less than 1,200 g/l.

Various techniques for forming laundry detergent tablets are well known in the art and may be used herein. The first step of manufacturing tablets usually involves granulating raw materials, such as by spray-drying and agglomeration. Typical spray-drying or agglomeration process known in the art can be used herein. By way of example, see the processes described in U.S. Pat. No. 5,133,924, issued Jul. 28, 1992; U.S. Pat. No. 4,637,891, issued Jan. 20, 1987; U.S. Pat. No. 4,726,908, issued Feb. 23, 1988; U.S. Pat. No. 5,160,657, issued Nov. 3, 1992; U.S. Pat. No. 5,164,108, issued Nov. 17, 1992; U.S. Pat. No. 5,569,645, issued Oct. 29, 1996. The granules are then combined with other actives, a binder and compressed into tablet form, e.g. using a rotary press. Due to the compaction force, tablets dissolve slower than powders with the same actives. Thus, combining good mechanical stability and rapid dissolution is a key challenge. Several approaches have been developed, e.g. high levels of water-soluble salts or the use of swellable polymers. Another approach is to generate a tablet with a softer, more readily dissolved core, coated with a harder protective "shell" that breaks easily when exposed to water. Preferred coatings include dicarboxylic acids and a disintegrant. Preferred density of these tablets is in the range of 1020-1070 g/l, preferred shape is rectangular and preferably used via the dosing drawer.

In another embodiment, the laundry detergent composition is provided in a liquid form comprising an aqueous, non-surface active liquid carrier. Generally, the amount of the aqueous, non-surface active liquid carrier employed in the compositions herein will be effective to solubilize, suspend or disperse the composition components. For example, the compositions may comprise, by weight, from about 5% to about 90%, or from about 10% to about 70%, or from about 20% to about 70% of the aqueous, non-surface active liquid carrier, such as water. The liquid laundry detergent compositions herein can be prepared by combining the components thereof in any convenient order and by mixing, e.g., agitating, the resulting component combination to form a phase stable liquid detergent composition. In an alternative embodiment for forming a liquid laundry detergent compositions, the reactive dye is first combined with one or more liquid components to form a dye premix which is added to a composition formulation containing a substantial portion, for example more than 50% by weight, more specifically, more than 70% by weight, and yet more specifically, more than 90% by weight, of the balance of components of the laundry detergent composition. For example, in the methodology described above, both the reactive dye premix and the enzyme component are added at a final stage of component additions. In a further embodiment, the reactive dye is encapsulated prior to addition to the detergent composition, the encapsulated dye is suspended in a structured liquid, and the suspension is added to a composition formulation containing a substantial portion of the balance of components of the laundry detergent composition.

Use Method

The compositions of this invention, prepared as hereinbefore described, can be used to form aqueous washing solutions for use in the laundering of fabrics. Generally, an effective amount of such compositions is added to water, preferably in a conventional fabric laundering automatic washing machine, to form such aqueous laundering solutions comprising from about 0.0005 ppm to about 0.5 ppm, or from about 0.005 ppm to about 0.25 ppm of a reactive dye. The aqueous washing solution so formed is then contacted, preferably under agitation, with the fabrics to be laundered under 40° C., but more than 3° C., and a pH of about 9-10. The present laundry detergent compositions comprising a surfactant and a specified reactive dye have been found to exhibit good tinting efficiency during a laundry wash cycle without exhibiting excessive undesirable build up after laundering.

Test Method

This protocol provides a comparative assessment of the whiteness performance of laundry detergent compositions. The test conditions are as follows: Miele Softronic W467 washing machines are used at 40° C. using the "Crease Resistant" washing cycle (1 hour wash cycle in total). The water hardness is adjusted to 359 ppm of calcium carbonate (21 gpg) by topping up the tap water with the required amount of $Ca^{2+}/Mg^{2+}$ at a 3/1 ratio. Identical whiteness terry towel and knitted cotton swatches are added to the washing machine with 25 g of AS1 artificial soil in a dosing ball and topped with white cotton ballast load (made of clean terry towels, T-shirts and flat cotton sheets). The total dry load weight is 3 kg.

Before starting the test the ballast load is pre-treated in Miele Softronic W467 washing machine using the normal cycle as follows: 1 wash at 30° C. with 50 g Dreft regular powder, 3 washes at 90° C. with 50 g Dreft regular powder and 3 washes at 90° C. without detergent. The ballast load is then dried in a Miele T490 using the extra dry cycle. Before the first cycle starts, the dry ballast load is being run with the rinse cycle in order to wet the load (not the whiteness swatches) at 359 ppm of calcium carbonate. The same ballast load is being re-used wet with the same product for the next cycles without intermediate drying.

The number of washing machines used equals the number of products to test, and the machines are used sequentially in order to have several internal and external whiteness replicates. To load the machines: mix the ballast load together with the necessary whiteness swatches, then add this total load to the washing machines, and finally add 25 g of AS1 artificial soil in a dosing ball on top of the load. The recommended dosage of each laundry detergent is added via the dispenser or in the drum depending on the manufacturer recommendation. Upon completion of the cycle, remove the empty dosing ball, remove all the whiteness swatches, dry them in a Miele T490 using the extra dry cycle. When the whiteness swatches are all dried, they are analyzed via a CM-3600d Minolta spectrophotometer and the "Polaris White Star" software version 1.1, both supplied by Axiphos GmbH. All measurements are taken within 48 h after the last washing cycles is over. During this time, the swatches are kept in a plastic bag away from the light. All swatches are preferably analyzed on the same day.

The spectrophotometer measures the L, a, b-values of the washed whiteness swatches with D65 illumination, CIE 10° observer.

Whiteness swatches and AS1 artificial soil are ordered at: Warwick Equest Limited, Unit 55, consett Business Park, Villa Real, Consett, County Durham, DH8 6BN, United Kingdom.

EXAMPLES

The following represent examples of laundry detergent compositions according to the present invention. All the percentages in Table 1 are by weight of the total detergent compositions. They are in no way meant to be limiting of the scope of the invention.

TABLE 1

| | Ex. 1 | Ex. 2 | Ex. 3 | Comparative Ex. 1 | Comparative Ex. 2 |
|---|---|---|---|---|---|
| Anionic agglomerates[1] | 37.2 | 37.2 | 37.2 | 37.2 | 37.2 |
| Nonionic agglomerates[2] | 5.0 | 5.0 | 5.0 | 5.0 | 5.0 |
| Cationic agglomerates[3] | 1.1 | 1.1 | 1.1 | 1.1 | 1.1 |
| Sodium percarbonate | 14.0 | 14.0 | 14.0 | 14.0 | 14.0 |
| Bleach activator agglomerates[4] | 5.7 | 5.7 | 5.7 | 5.7 | 5.7 |
| Sodium carbonate | 6.9 | 6.9 | 6.9 | 6.9 | 6.9 |
| Silicates | 4.0 | 4.0 | 4.0 | 4.0 | 4.0 |
| Sulphates | 3.1 | 3.1 | 3.1 | 3.1 | 3.1 |
| Citrates | 6.1 | 6.1 | 6.1 | 6.1 | 6.1 |
| Tetrasodium salt of hydroxyethane diphosphonic acid | 1.2 | 1.2 | 1.2 | 1.2 | 1.2 |

TABLE 1-continued

| | Ex. 1 | Ex. 2 | Ex. 3 | Comparative Ex. 1 | Comparative Ex. 2 |
|---|---|---|---|---|---|
| Polymers | 2.3 | 2.3 | 2.3 | 2.3 | 2.3 |
| Fluorescer | 0.7 | 0.7 | 0.7 | 0.7 | 0.7 |
| Suds suppressor[5] | 0.6 | 0.6 | 0.6 | 0.6 | 0.6 |
| Citric acid | 0.9 | 0.9 | 0.9 | 0.9 | 0.9 |
| Protease | 0.3 | 0.3 | 0.3 | 0.3 | 0.3 |
| Lipase | 0.3 | 0.3 | 0.3 | 0.3 | 0.3 |
| Cellulase | 0.2 | 0.2 | 0.2 | 0.2 | 0.2 |
| Amylase | 0.4 | 0.4 | 0.4 | 0.4 | 0.4 |
| Binder system | 5.0 | 5.0 | 5.0 | 5.0 | 5.0 |
| Perfume | 0.5 | 0.5 | 0.5 | 0.5 | 0.5 |
| C.I. Reactive Red 239 | 10 ppm | 18 ppm | 5 ppm | | |
| C.I. Reative Blue 19 | 5 ppm | | 5 ppm | | |
| C.I. Direct Violet 99 | | | | 3.16 ppm | 2.2 ppm |
| Balance | | | to 100 | | |

[1]Anionic agglomerates comprise 40% anionic surfactant, 40% zeolite and 20% carbonate.
[2]Nonionic agglomerates comprise 26% nonionic surfactant, 6% Lutensit K-HD 96, 40% sodium acetate anhydrous, 20% carbonate and 8% zeolite.
[3]Cationic agglomerates comprise 23% cationic surfactant, 62% zeolite and 15% water.
[4]Bleach activator agglomerates comprise 81% TAED, 17% acrylic/maleic copolymer (acid form) and 2% water.
[5]Suds suppressor comprises 11.5% silicone oil, 60% of zeolite and 28.5% of water.

The whiteness performance of the laundry detergent compositions of Example 1, Example 2 and Comparative Example 1 are tested according to the test method described above. Data in the following Table 2 shows that laundry detergent compositions containing reactive dyes of the present invention give a more appealing hue (higher L, higher a, lower b) upon 1 cycle of wash on white fabrics than that containing a direct dye.

TABLE 2

| | | Comparative example 1 | Example 1 | Example 2 |
|---|---|---|---|---|
| Knitted cotton | L | 98.10 | 98.50 | 98.05 |
| | a | 3.51 | 3.55 | 3.57 |
| | b | −14.16 | −14.46 | −14.26 |
| Terry towel | L | 98.48 | 98.72 | 98.73 |
| | a | 2.84 | 3.35 | 3.41 |
| | b | −12.68 | −14.14 | −14.10 |

The buildup performance of laundry detergent compositions of Example 3 and Comparative Example 2 are tested according to the test method described above. The level of reactive dye and direct dye in the laundry detergent composition is adjusted to give a similar initial L, a and b values upon 1 washing cycle. Data in the following Table 3 shows that laundry detergent compositions containing reactive dyes have less buildup of dyes on fabrics after multiple cycles of washes than that containing a direct dye.

TABLE 3

| | L-value | | a-value | | b-value | |
|---|---|---|---|---|---|---|
| | Example 3 | Comparative Example 2 | Example 3 | Comparative Example 2 | Example 3 | Comparative Example 2 |
| Cycle 1 | 97.80 | 97.80 | 3.13 | 3.13 | −13.59 | −13.65 |
| Cycles 4 | 97.87 | 97.73 | 3.02 | 3.10 | −13.83 | −14.08 |
| Cycles 8 | 97.85 | 97.56 | 2.91 | 3.00 | −13.86 | −14.04 |
| Cycles 12 | 97.86 | 97.45 | 2.74 | 2.93 | −13.73 | −14.30 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for laundering fabrics, comprising the steps of:

i. contacting the fabrics, said fabrics comprising cotton, with an aqueous solution of laundry detergent composition, said laundry detergent composition comprising from about 3% to about 50% by weight of a surfactant and from about 0.00001% to about 0.01% by weight of a combination of a reactive blue dye and a reactive red dye in a weight ratio of from 1:9 to 9:1 wherein said reactive blue dye is selected from the group consisting of dyes having the color index names reactive blue 268, reactive blue 224, reactive blue 209, reactive blue 19, and a mixture thereof and wherein said reactive red dye is selected from the group consisting of reactive red 238, reactive red 239 and a mixture thereof, said laundry detergent composition further comprising from about 1% to about 30% by weight of a bleaching agent, at a temperature of less than 40° C. but more than 3° C. and at a pH of from about 9 to about 10; and ii. rinsing and drying the fabrics, wherein said aqueous solution comprises from about 0.0005 ppm to about 0.5 ppm by weight of said combination of reactive dyes.

* * * * *